US011295908B2

(12) United States Patent
Gauthier et al.

(10) Patent No.: US 11,295,908 B2
(45) Date of Patent: Apr. 5, 2022

(54) ELECTRICAL TACTILE SWITCH WITH AXIAL POSITIONING OF THE ACTUATING SECTION OF THE DEFORMABLE ACTUATOR

(71) Applicant: C&K COMPONENTS S.A.S., Dole (FR)

(72) Inventors: Philippe Gauthier, Liesle (FR); David Ferraton, Dole (FR); Laurent Kubat, Dole (FR)

(73) Assignee: C&K COMPONENTS S.A.S., Dole (FR)

( * ) Notice: Subject to any disclaimer, the term of this patent is extended or adjusted under 35 U.S.C. 154(b) by 0 days.

(21) Appl. No.: 17/262,069

(22) PCT Filed: Jul. 4, 2019

(86) PCT No.: PCT/EP2019/067981

§ 371 (c)(1),
(2) Date: Jan. 21, 2021

(87) PCT Pub. No.: WO2020/020597

PCT Pub. Date: Jan. 30, 2020

(65) Prior Publication Data

US 2021/0304980 A1 Sep. 30, 2021

(30) Foreign Application Priority Data

Jul. 25, 2018 (FR) ..... 1856880

(51) Int. Cl.
*H01H 13/48* (2006.01)
*H01H 13/04* (2006.01)
*H01H 13/14* (2006.01)

(52) U.S. Cl.
CPC ..... *H01H 13/48* (2013.01); *H01H 13/04* (2013.01); *H01H 13/14* (2013.01);
(Continued)

(58) Field of Classification Search
CPC ..... H01H 13/48; H01H 13/04; H01H 13/14
(Continued)

(56) References Cited

U.S. PATENT DOCUMENTS 6,774,330 B2 * 8/2004 Blossfeld ..... H01H 13/702 200/406
2007/0235312 A1 * 10/2007 Takeuchi ..... H01H 13/48 200/520
2012/0061214 A1 3/2012 Buss

FOREIGN PATENT DOCUMENTS

CN 202042403 U 11/2011
FR 2876834 A1 4/2006
(Continued)

*Primary Examiner* — Edwin A. Leon
*Assistant Examiner* — Iman Malakooti
(74) *Attorney, Agent, or Firm* — Fox Rothschild LLP

(57) ABSTRACT

The invention provides an axially actuating tactile electrical switch comprising a casing; a plurality of independent fixed electrical contacts arranged in a base of the casing, and a movable electrical contact comprising a peripheral portion resting on a portion of a fixed peripheral electrical contact and a central portion movable vertically downwards; a single piece actuating body made of elastic material comprising a peripheral portion, an actuating central part comprising a lower portion for actuating the movable electrical contact, and an upper portion for receiving an actuating force, forming a casing comprising an upper cover having a hole whereby a free upper end section of the upper portion extends axially; the cover has an internal retaining surface; and the actuating body has an abutment surface cooperating with the internal retaining surface of the cover to determine an upper rest position of the actuating body with respect to the casing.

16 Claims, 6 Drawing Sheets

(52) U.S. Cl.
CPC ... *H01H 2205/02* (2013.01); *H01H 2205/028* (2013.01); *H01H 2227/026* (2013.01); *H01H 2229/02* (2013.01)

(58) Field of Classification Search
USPC ..... 200/406
See application file for complete search history.

(56) References Cited

FOREIGN PATENT DOCUMENTS

| | | | |
|---|---|---|---|
| JP | S60 822 | B2 | 1/1985 |
| JP | S63 153436 | U | 10/1988 |
| JP | 2015 149149 | A | 8/2015 |

* cited by examiner

ELECTRICAL TACTILE SWITCH WITH AXIAL POSITIONING OF THE ACTUATING SECTION OF THE DEFORMABLE ACTUATOR

RELATED APPLICATIONS AND CLAIM OF PRIORITY

This application is a national stage application of, and claims priority to, International Patent Application No. PCT/EP2019/067981, filed Jul. 4, 2019, which claims priority to France Patent Application No. 1856880 filed Jul. 25, 2018.

TECHNICAL FIELD

The invention concerns an electric switch with tactile effect.

BACKGROUND

Document JP-560-822-U-7 describes and represents an electrical switch whose actuating body has no stop surface allowing precise control of the vertical dimension of the free end section of the upper portion of the central part of the actuating body made of elastic material on which the actuating force is exerted. Indeed, in this document, it is an upper face of the intermediate part (which connects the peripheral part 424 and the central actuating part 423) which is vertically upwardly supported against a facing portion of cover 43.

For the integration and use of such an electrical switch in a device or sub-assembly, it is desirable to be able to precisely control the vertical dimension of the free end section of the upper portion of the central actuating body made of elastic material on which the actuating force is exerted.

The invention aims to propose a solution to this problem.

BRIEF SUMMARY

The invention relates more particularly to a tactile-effect electrical switch of the type comprising a movable electrical contact forming a triggering member, for example in the general shape of a dome, on which a single piece actuating body made of elastic material acts directly.

In a known manner, the actuating body made of elastic material in a single piece is arranged in a casing of the switch, and it comprises a central part comprising a lower support portion which is directed downwards in the direction of the movable portion facing the movable electrical contact, and an upper portion for receiving an actuating force which is arranged to receive a force oriented generally vertically downwards.

The actuating force may be applied directly to an upper free end face of said upper portion which projects vertically upward out of the casing.

The lower supporting portion of the central part which is directed downwards, towards the movable portion opposite the movable electrical contact, can be in permanent axial support—without play—on the movable portion opposite the movable electrical contact.

In the rest state of the switch (without any actuating force exerted by a user), the lower support portion of the central part which is directed downwards can, alternatively, extend opposite the movable portion facing the movable electrical contact with axial play defining a pre-actuating stroke.

The actuating body also has a peripheral part, connected to its central part, which supports the actuating body elastically with respect to the casing.

In such a type of switch, the movable electrical contact comprises an annular peripheral portion, whether circular or not, which rests axially downwards against an opposing portion of a bottom surface of a base part of the switch casing by making electrical contact with at least one fixed electrical contact arranged opposite in the bottom of the casing base.

In order to keep this peripheral portion of the movable electrical contact in axial downward abutment, the actuating body made of elastic material may comprise a part—radially intermediate between its central part and its peripheral part—for holding the peripheral portion of the movable electrical contact in axial abutment on said portion facing said surface.

The invention provides an electric switch with tactile effect and axial actuating comprising:

- a casing made of insulating material comprising a lower base delimiting a housing open vertically upwards;
- a plurality of independent fixed electrical contacts which are arranged in a vertically upwardly oriented surface of said base, and which comprise at least a first fixed electrical contact and a second fixed electrical contact;
- an elastically deformable movable electrical contact which is arranged above said surface of the base and which has a peripheral portion in electrical contact with the first fixed electrical contact, and a central portion which is movable vertically downwards, towards the second fixed electrical contact;
- a single piece actuating body of elastic material which is arranged in the casing, and which comprises:

i) a central actuating portion comprising:

- a lower actuating portion of the movable electrical contact which faces downwardly towards the movable portion of the movable electrical contact,
- and an upper portion for receiving an actuating force which is arranged to receive a generally vertically downwards directed force, ii) a peripheral part, connected to the central part, supporting the elastic actuating body with respect to the casing;

iii) and an intermediate part which connects the peripheral part and the central actuating part to each other, In that:

- the casing made of insulating material has an upper cover which extends axially upwards above the lower base and an upper wall of which has a hole through which a free upper end section of the upper portion of the central part of the actuating body extends axially, forming a push button for actuating the electric switch;
- the upper cover has an internal retaining surface;
- the upper portion of the central part of the actuating body has a stop surface which cooperates with said internal retaining surface, towards which it is elastically biased, to determine an upper rest position of the upper portion of the central part of the actuating body relative to the casing;

According to other features of the invention:

- the upper cover has an upper transverse wall in which said hole is formed, and said internal retaining surface is a portion of the inner face of this transverse wall;
- the upper portion of the central part of the actuating body is a stepped portion comprising at least two adjacent axial sections delimited by a shoulder whose transverse annular surface constitutes said stop surface which cooperates with said internal retaining surface of the cover;

the upper cover is attached to the lower base by laser welding;

the upper cover and the lower base are assembled according to a peripheral parting line which extends in a transverse plane orthogonal to the axis of actuating of the electric switch;

the parting plane extends in a continuous ring;

the upper cover has an annular lower flange for fixing the upper cover to the lower base and an upper body in the shape of a truncated cone or cylinder which is stiffened by axial ribs;

the peripheral part of the actuating body made of elastic material is housed with radial clearance in a recess in the lower casing base;

the peripheral part of the actuating body has an annular peripheral lip which is axially clamped in a sealed manner between opposing and facing portions of the base and the upper cover;

the lower base has positioning and holding elements that cooperate with the annular peripheral lip of the peripheral part of the actuating body;

the actuating body is elastically biased upwards by the elastically deformable movable electrical contact which is in permanent elastic support against the lower portion of the central part of the actuating body;

the movable contact is arranged so that:

in a normal state of rest, the movable central portion of the movable electrical contact is spaced from said fixed central electrical contact;

when the movable contact is subjected to a vertically downward actuating force of a predetermined value, the movable central portion of the movable electrical contact is in contact with the second fixed electrical contact, so as to electrically connect the first and second fixed electrical contacts;

the actuating body is made by molding in a silicone-based elastomer material.

BRIEF DESCRIPTION OF THE FIGURES

Other characteristics and advantages of the invention will appear during the reading of the detailed description that will follow for the understanding of which one will refer to the annexed drawings in which.

DETAILED DESCRIPTION

Figure 1:
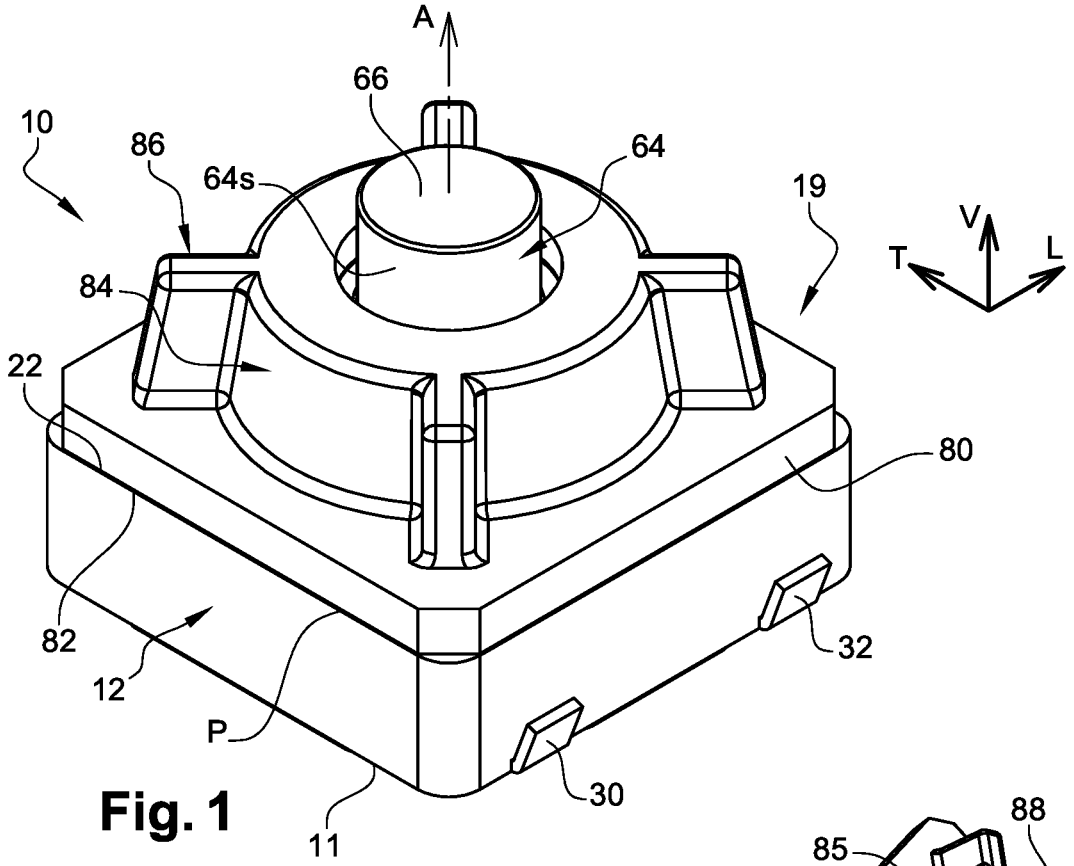
FIG. 1 is a perspective view of a first mode of realization of an electric switch according to the invention.
Figure 2:
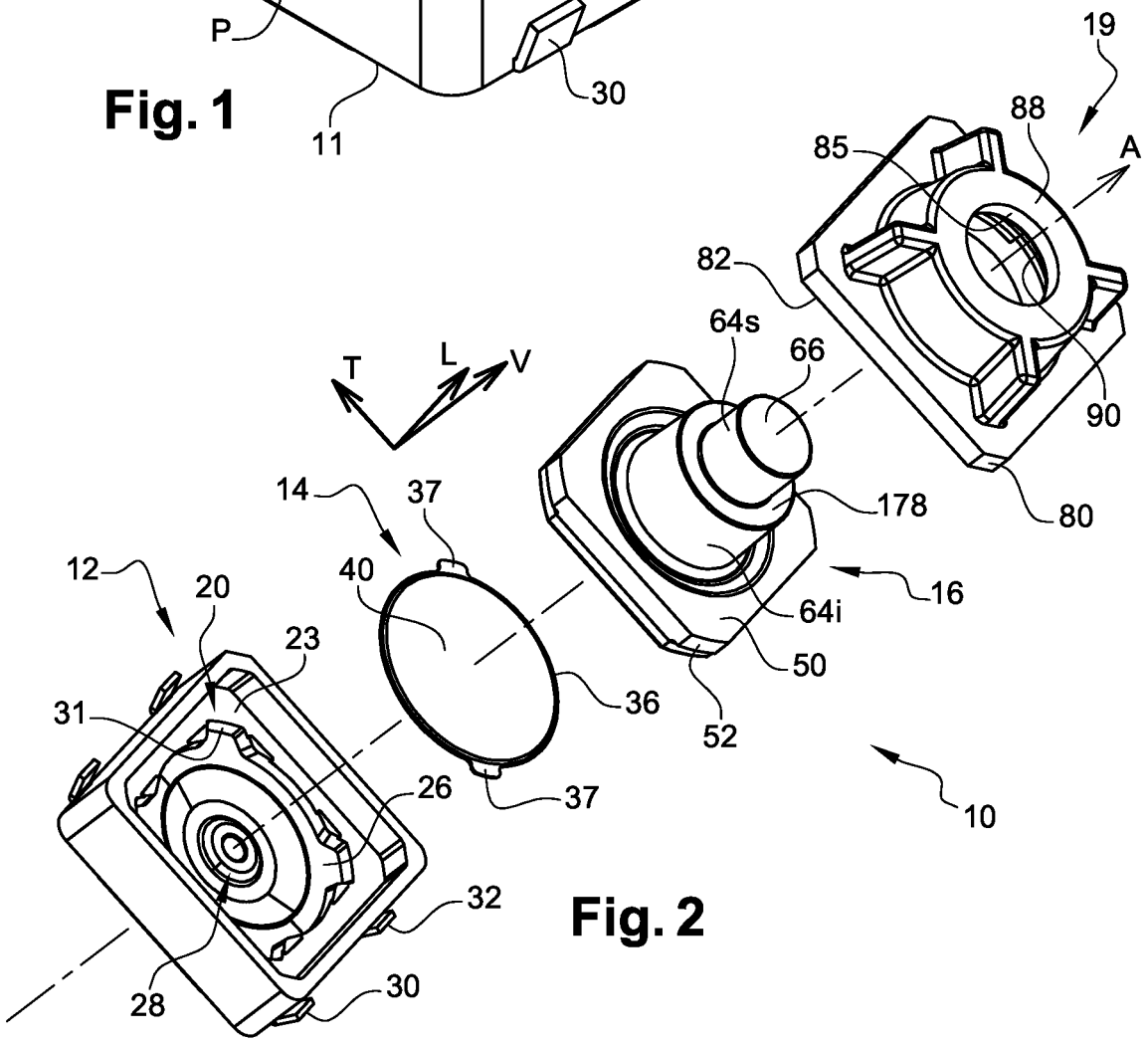
FIG. 2 is an exploded perspective view of the various components of the electric switch illustrated in FIG. 1.
Figure 3:
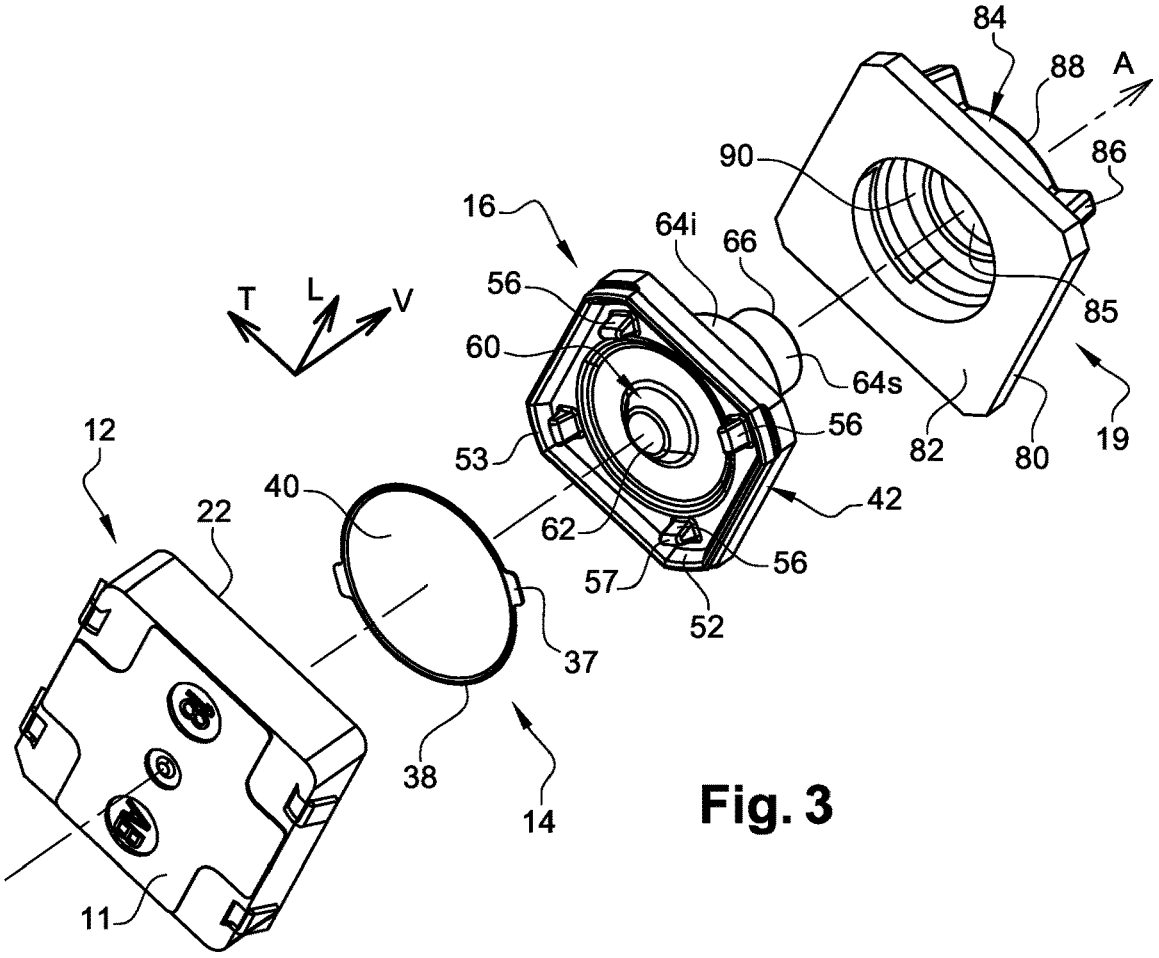
FIG. 3 is an exploded perspective view similar to that of FIG. 2, from another angle of view.
Figure 4:
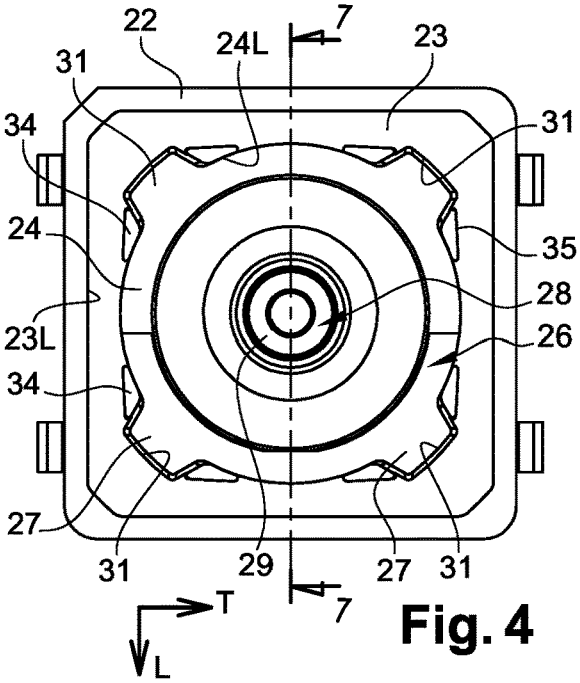
FIG. 4 is a top view of the lower base part of the electrical switch casing shown in FIG. 1.
Figure 5:
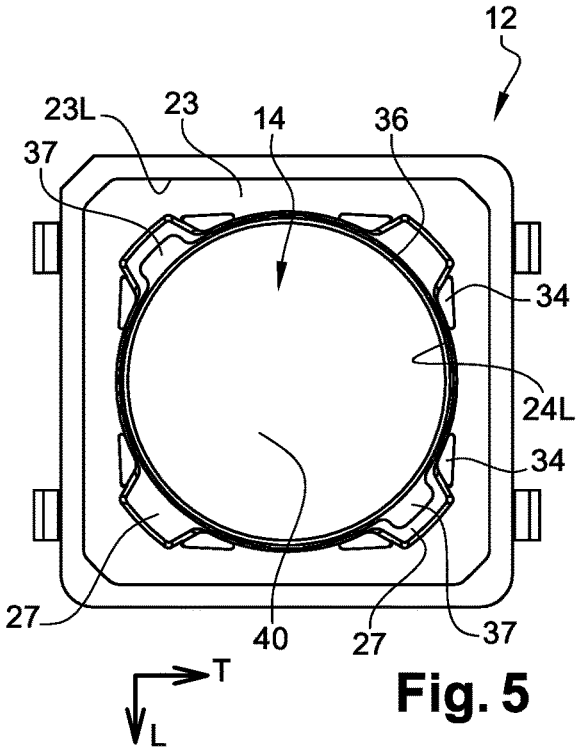
FIG. 5 is a view similar to that of FIG. 4 in which the movable electrical contact in the mounted position in the base shown in FIG. 4 is shown.
Figure 6:
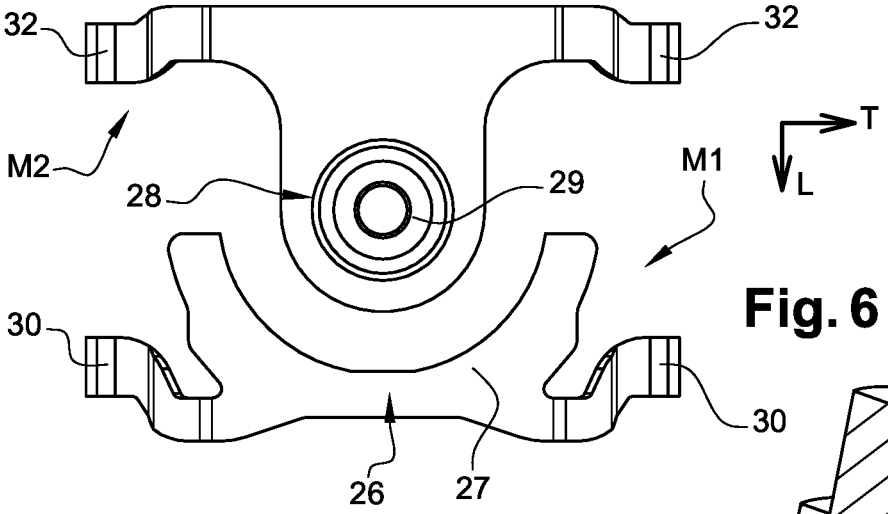
FIG. 6 is a top view showing the fixed electrical contact elements built into the base shown in FIG. 4.

In the rest of the description, elements with identical structure or similar functions will be designated by the same references.

In the rest of the description, longitudinal, vertical and transverse orientations indicated by the trihedron "L,V,T" of the figures will be adopted in a non-limitative way. A horizontal plane extending longitudinally and transversally is also defined.

The general and central axis A of the switch is parallel to the vertical direction V and is oriented from bottom to top. The switch actuating force F is oriented generally vertically from top to bottom.

In particular, FIGS. 1 to 16 show an electrical switch 10 consisting essentially of, vertically from bottom to top, a lower base 12, a movable electrical contact 14, an actuating body 16, an upper actuating push button 18, and an upper cover 19.

The lower base plate 12 and the upper cover 19 form the casing of the electrical switch 10.

These components are stacked vertically along the vertical central axis A of the switch.

The lower part of base 12 is a square parallelepiped shape.

Like the cover 19, the lower base 12 is made of one or more electrically insulating plastic materials.

The base plate 12 is delimited downwards by a horizontal lower side 11.

Base 12 delimits an internal housing 20 which is open vertically upwards and opens into a horizontal flat annular upper side 22 of base 12.

Figure 7:
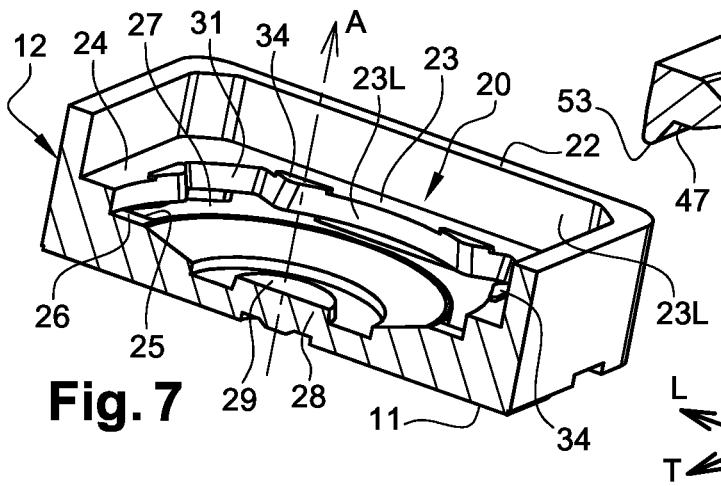
FIG. 7 is a detail perspective view of the base part shown in FIG. 4, which is shown in cross section according to Plan 7-7 in FIG. 4.
Figure 8:
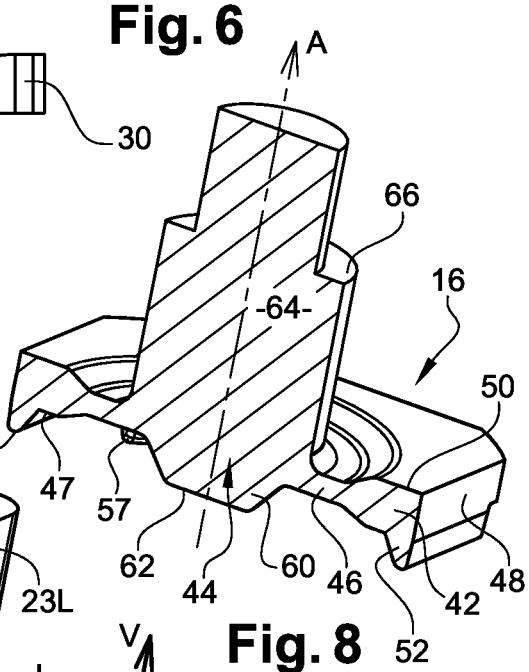
FIG. 8 is a detail perspective view of the actuating body shown in FIGS. 2 and 3, which is shown in cross section according to Plan 10-10 in FIG. 9.
Figure 9:
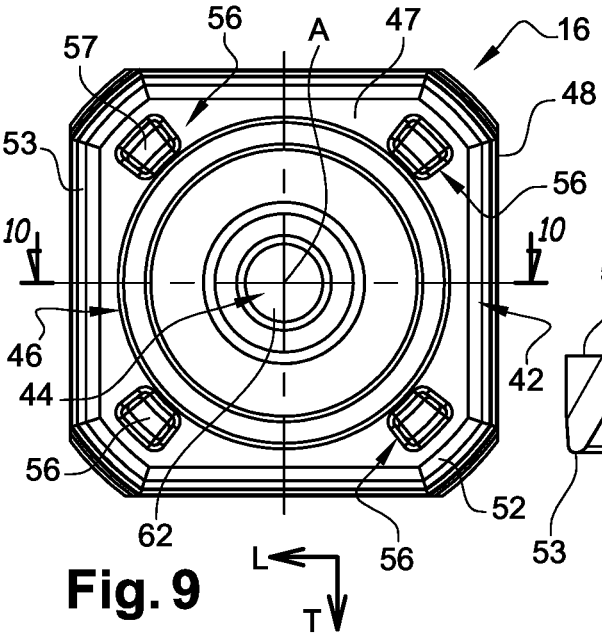
FIG. 9 is a bottom view of the actuating body shown in FIGS. 2, 3 and 8.
Figure 10:
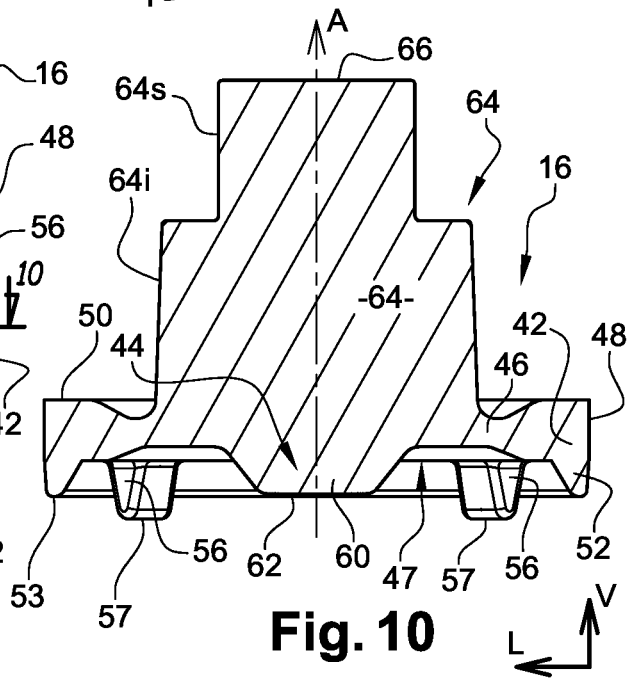
FIG. 10 is a view of the actuating body shown in FIG. 9, which is shown in cross-section along Plane 10-10 of FIG. 9.
Figure 11:
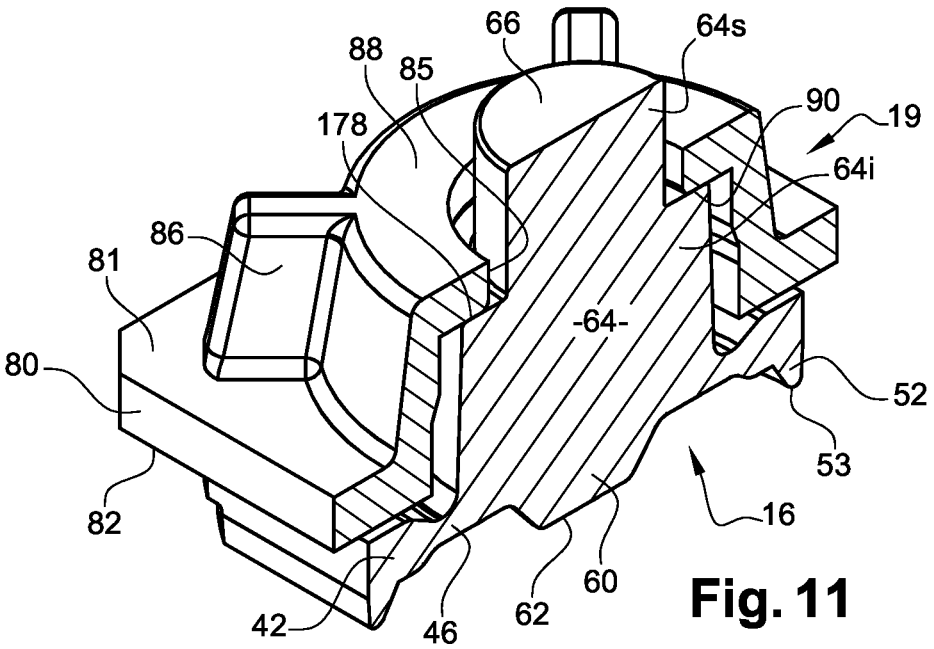
FIG. 11 is a detailed perspective and sectional view through an axial plane which illustrates the cooperation between the actuating body and the upper cover of the switch casing shown in FIGS. 1 to 3.
Figure 12:
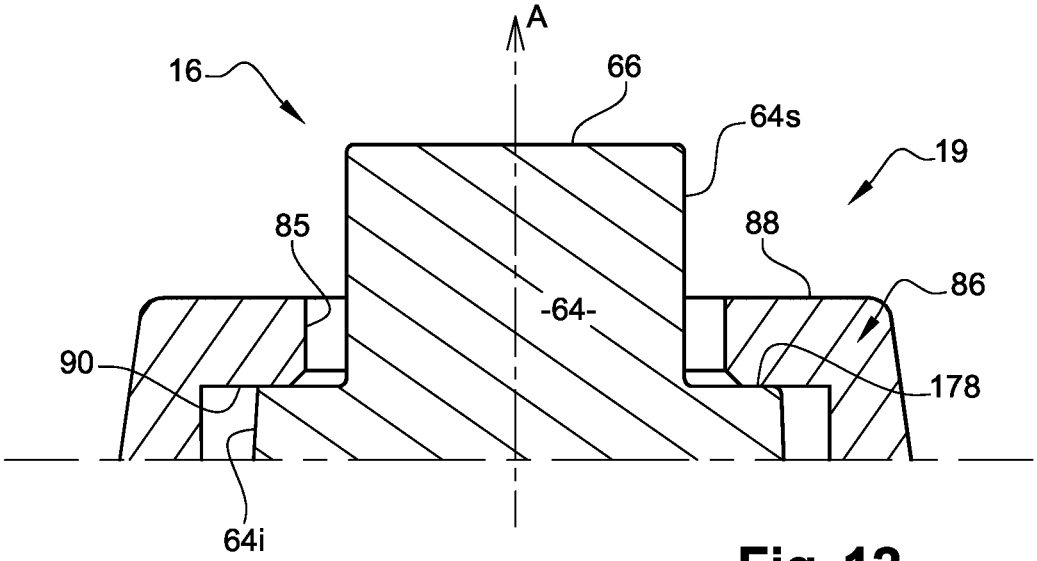
FIG. 12 is a detailed axial sectional view showing the cooperation between the actuating body and the upper cover of the switch casing shown in FIGS. 1 to 3.

As can be seen in particular in FIG. 7, housing 20 is delimited by a horizontal annular bottom surface 24 in which a first lateral or peripheral contact 26 and a second central contact 28 are fixedly arranged, and by another intermediate peripheral annular surface 23 located higher up.

The first fixed peripheral electrical contact 26 is in the form of an annular conductive strip which extends here on a semicircle and which comprises two radial tabs 27 distributed at 90 degrees of angle, each facing a corner of the lower base 12.

Figure 13:
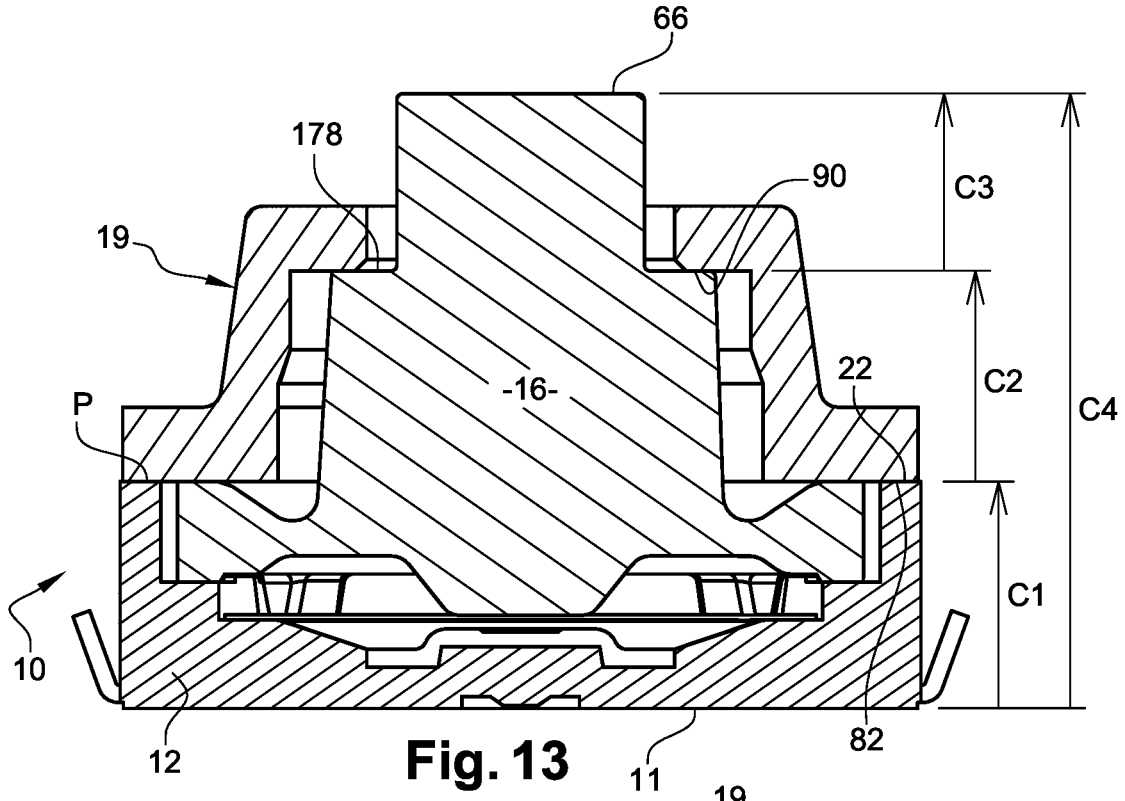
FIG. 13 is a schematic half axial sectional view of the switch casing shown in FIGS. 1 through 3.

The second central fixed electrical contact 28 is in the form of a central conductive pad which extends in relief above the bottom of the inner housing 20 and which is here delimited by an annular upper contact face 29 which, as can be seen in particular in FIGS. 7 and 13, extends in a horizontal plane which is slightly offset axially downwards with respect to the plane of the conductive upper face 25 of the first fixed lateral contact 26 which is here coplanar with the bottom surface 24.

The electrical contacts and terminals 26, 28, 30 and 32 belong to two cut and bent elements of conductive material M1, M2 which are embedded by over molding in the insulating material of the lower base plate 12.

The first fixed side contact 26 is electrically connected to external electrical connection terminals 30, while the second fixed center contact 28 is connected to another pair of external connection terminals 32.

The lower most part of housing 20 bounded by surface 24 is bounded by a concave cylindrical vertical side wall 24L, while the upper most part of housing 20 bounded by surface 23 is bounded by a concave vertical side wall 23L with a square contour parallel to the outer side wall of the lower base 12.

At each of the four corners of the lower base 12, the side wall 24L has a recess 31.

The lower base 12 also has four series of pairs of vertical pins 34 that extend vertically upward above the plane of the annular surface 23 and, in pairs, are adjacent to a recess 31.

Each pin 34 is bounded by a flat vertical outer wall 35.

The central electrical contact known as the movable contact 14 is an elastically deformable tripping device.

In this design, the electrical contact 14 is in the shape of a curved dome with its convexity facing upwards, and with a circular contour.

The movable electrical contact 14 is received, with radial clearance, in the part of the housing 20 delimited by surface 24 and the side wall 24L.

The movable electrical contact 14 comprises a first peripheral portion or annular lateral portion 36 which is not movable in the sense of the invention and which, by its conductive circular annular lower face 38, is in permanent electrical contact with the upper face 25 of the fixed peripheral electrical contact 26.

The movable electrical contact 14 comprises a second central portion 40 which is elastically deformable.

The design of the movable electrical contact 14 and its arrangement in the lower base 12 are such that, in its normal state of rest shown in the figures, the second movable central portion 40 of the movable electrical contact 14 is vertically spaced, along the axis A, from the annular upper face 29 of the second central fixed contact 28; i.e. the electrical switching way between the first lateral fixed contact 26 and the second central fixed contact 28 is not established.

There is then no electrical switching way established between the external terminals 30 and 32.

Beyond the circular contour of its first peripheral portion or annular lateral portion 36, the movable electrical contact 14 here comprises a pair of diametrically opposed external radial tabs 37 which are coplanar with each other and coplanar with the conductive circular annular underside 38.

Each of the two outer radial tabs 37 is received with clearance in an associated recess 31.

Thus, the movable electrical contact 14 is globally immobilized in rotation with respect to the lower base 12, thus avoiding the appearance of local micro corrosion phenomena resulting from friction on the fixed contact due to possible rotational movements of the movable electrical contact 14.

The one of the two external radial tabs 37, which is arranged above one of the radial tabs 27 of the fixed peripheral electrical contact 26 (in the lower right-hand corner of FIG. 5), also contributes to the quality of the electrical contact.

The movable electrical contact 14 also has a central portion 40 which is capable of receiving an actuating force, oriented vertically from top to bottom, to cause an elastic deformation of the movable electrical contact 14 and, in a known manner, its change of state in order to bring the lower conducting face of the central portion 40 into electrical contact with the central fixed contact 28.

The actuating body 16 is a single component made of an elastically deformable material such as elastomer material or natural or synthetic rubber.

The actuating body 16 is generally in the form of a plate located at the bottom and extending in a horizontal plane.

The actuating body 16 consists of a side or peripheral part 42, a central actuating part 44 and an intermediate part 46 which connects the peripheral part 42 and the central actuating part 44.

The plate of the actuating body 16 is generally square on the outside and is dimensioned so that it can be received in housing 20 of the lower base plate 12.

More precisely, the plate of the actuating body 16 is received in the upper part of the housing 20 which is vertically delimited downwards by the annular surface 23, and laterally by the side wall 23L.

For this purpose, the peripheral part 42 is delimited laterally towards the outside by a vertical side wall 48 with a square contour complementary to that of the side wall 23L so as to be received with a slight radial clearance.

Peripheral part 42 is vertically delimited upwards by a horizontal flat surface 50, while at its lower part it has a lower peripheral lip 52 of triangular profile which, in the mounted position of the lower plate of the actuating body 16 in the lower base 12, rests against the annular surface 23.

The lower circumferential lip 52 is dimensioned and positioned in such a way that it cooperates with the pins[2] when the actuator 16 is inserted into the lower base plate 12 and then axially clamped by the cover 19 to position the lower circumferential lip, maintaining it and/or avoiding undesired deformations of this peripheral part 42 of the actuating body 16 which ensures both its support in relation to the lower base 12 and the sealing of the part of the housing 20 which is located below the actuating body 16 and in which the fixed electrical contacts 28 and 26, and the mobile movable electrical contact 14 are located.

Here as a non-limiting example, under the lower face 47 of its intermediate portion 46, the actuating body 16 comprises four feet 56 each of which extends generally downwards and each of which is delimited by a lower edge 57.

Each of the four feet 56 is here arranged facing an associated corner of the actuating body 16 of square contour.

The four feet 56 are arranged on the same circle centered on the central axis A.

The four lower edges 57 lie substantially in the same horizontal plane which is vertically offset downward from the plane in which the lower edge 53 of the peripheral lip 52 lies.

In the mounted position of the lower plate of the actuating body 16 in the lower base plate 12, the four lower edges 56 extend vertically downwards below the plane of the horizontal annular surface 23.

In the mounted and assembled position of all the components of the electrical switch 10, and in particular of the actuating body 16 housed and clamped in housing 20 of the lower base plate 12, each of the feet 56 is dimensioned and positioned in such a way that it can be supported at a point, or substantially at a point, axially downwards on an area opposite the upper face of the movable electrical contact 14.

In this mode of construction, only two of the four diametrically opposed support feet 56 are each supported on a facing portion of the movable electrical contact 14, which in this case is an associated radial leg 37 of the movable electrical contact 14.

The central actuating part 44 of the actuating body 16 has a lower actuating portion 60 of the movable electrical contact 14 which is vertically delimited downwards by a central lower disc 62 which is able to cooperate with the opposite portion of the upper face of the central portion 40 of the movable electrical contact 14.

The central actuating part 44 of the actuating body 16 also has an upper portion 64 which is vertically upwardly bounded by a central upper disc 66 which is capable of receiving an actuating force F from the electrical switch 10 in order to cause the change of state of the movable electrical contact 14 to establish the electrical switching way between the fixed electrical contacts 26 and 28.

The central part 44 of the actuating body 16 thus has an upper portion 64 which is in the form of an upper section which extends axially upwards projecting beyond the plane of the upper face 50 of the peripheral part 42.

To apply an actuating force to the upper portion 64 of the actuating body 16, this upper portion 64 has a stepped structure with a lower section **64*i* of larger diameter and an upper section of smaller diameter 64*s* which are delimited axially with respect to each other by an annular shoulder 178 which acts as a stop surface to determine the upper axial rest position of the upper actuating section 64*s* with respect to the cover 19 and the casing 12-19**.

Thus, the upper portion 64 of the central part 44 of the actuating body 16 is a stepped portion comprising at least two adjacent axial sections **64*i*, 64*s* delimited by a shoulder 178 whose transverse annular surface constitutes the stop surface that cooperates with the internal retaining surface 90 of the cover 19, towards which it is resiliently biased, to determine an upper rest position of the upper portion 64 of the central part 44 of the actuating body 16 with respect to the casing 12-19**.

The upper cover 19 is a metal part or a rigid plastic molding.

The upper cover 19 has a lower horizontal plate 80 for fixing the upper cover 19 to the lower base plate 12 and for axially sealingly clamping the peripheral part 42 of the actuating body 16.

The lower plate 80 is centrally holed and is bounded vertically downwards by a horizontal bottom plate 82.

Thus, the upper cover 19 has a lower annular collar.

Above the lower plate 80, the upper cover 19 is extended axially upwards by a hollow cylindrical body 84, which is holed centrally through an axial through-hole 85 and is here stiffened by external axial ribs 86.

The upper wall 88 of the upper cover 19 is an annular wall through which the upper, smaller diameter, free end section **64*s* of the upper stepped portion 64 of the actuating body 16** extends axially.

In the rest state shown in particular in FIG. 1, and as an example, the upper face 66 of the upper section of smaller diameter **64*s* is here vertically offset upwards with respect to the upper wall 88 of the upper cover 19**.

In order to retain the upper section **64*s* of the central part 44 of the actuating body 16 axially upwards and to determine its vertical position in the resting state, the hollow cylindrical body 84 of the upper cover 19 delimits an internal radial shoulder 90—oriented vertically downwards—which constitutes a retaining surface which is capable of cooperating with the opposite shoulder 178 oriented vertically upwards of the upper section 64*s***.

The shoulder 90 is here constituted by the lower inner annular face of the upper wall 88 of the upper cover 19.

In order to determine the precise vertical resting position by mutual bearing of surfaces 178 and 90, and to avoid interference noise due to vibrations to which the electrical switch 10 could be subjected, the central part 44 of the actuating body must be elastically returned vertically upwards.

As shown schematically in FIG. **14*b*, such an effect or elastic restoring force can be provided by the actuating body 16 whose inherent elasticity may, in its resting state, allow such a restoring force to be applied to its central part 44. Such a solution can then be associated with a design in which, in the rest state, there is a vertical or axial play "J" between the lower support disc 62 of the central part 60 of the actuating body 16 and the opposite central portion of the upper face of the movable electrical contact 14. Thus, it is possible to have a pre-stroke or dead travel before actually acting on the movable electrical contact 14**.

Figure 14A:
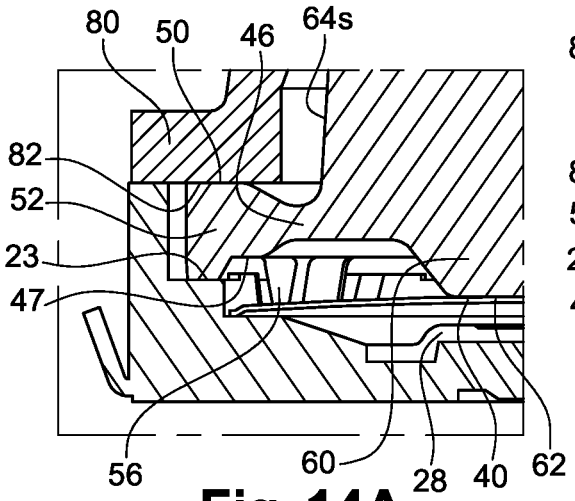
FIG. 14A is a sectional view, according to the sectional plane of FIGS. 11 to 13, showing a central portion of the subassembly shown in FIGS. 11 to 13, with the electrical switch shown in FIGS. 1 to 3 in its resting state with no dead travel between the actuating body and the movable electrical contact.
Figure 14B:
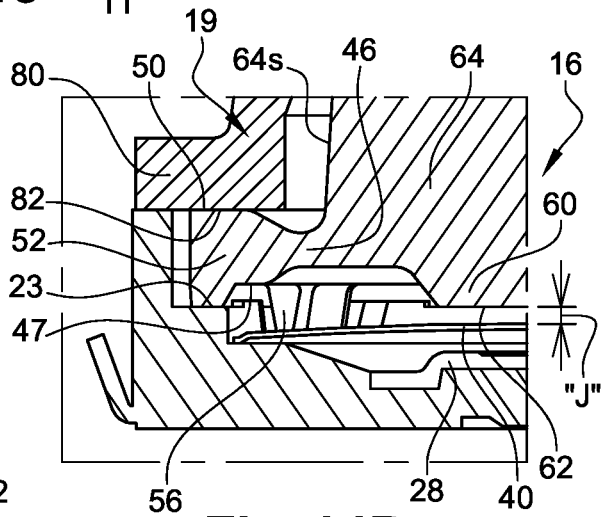
FIG. 14B is a view analogous to that of FIG. 14A in which, alternatively, the switch shown in FIGS. 1 to 3 is in its rest condition, but with a dead travel between the actuating body and the movable electrical contact.

Alternatively, and as shown in FIG. 14A, the vertically upward spring return of the central part 44 of the actuating 16 can also be combined with a design without dead travel in which the lower support disc 62 is always in contact with the central portion opposite the upper face of the movable electrical contact 14, without axial play, the movable electrical contact 14 being then slightly compressed axially, ensuring that the axial play of the assembly is taken up.

For the assembly and fastening of the upper cover 19 to the lower base plate 12, the two components are along a continuous annular peripheral parting line P which corresponds to the contact plane of the flat horizontal annular surfaces 22 of the lower base plate 12 and 82 of the lower collar 80 of the upper cover 19.

The parting plane P thus extends in a horizontal plane which is generally orthogonal to the axis A of actuating of the electrical switch 10.

The choice of materials for the lower base plate 12 and the upper cover 19 is such that they can be attached by welding with a laser called "laser welding".

Thanks to this design and assembly and fastening technique, the casing 12-19 has a high rigidity and does not deform when, for example, electrical switch 10 is attached by welding to a printed circuit board.

This assembly technique also ensures a good seal at the parting line P.

As will be explained below, this technique also ensures a high degree of consistency and uniformity of the different internal and external functional dimensions of the electrical switch.

The lower flange 80 of the upper cover 19 extends radially inwards far beyond the annular upper face 22 of the lower base plate 12.

Thus, in cooperation with the upper horizontal face 50 of the peripheral part 42 of the actuating body 16, the lower horizontal face 82 forms a sealing clamping surface by axial compression of this peripheral part 42 and in particular of the peripheral lip 52 against the opposite surface 23 of the lower base plate 12.

In combination with the very rigid design of the cover 19, which results in particular from the presence of the ribs 86, laser welding between the two surfaces at the level of the parting line P provides the assembly with very high resistance capacity in the event of overload during actuating, which is then transmitted to the annular upper wall 88 of the upper cover 19 and received by the upper cover 19 and the lower base plate 12, without any deformation or risk of the two components of the casing being separated.

Figure 17:
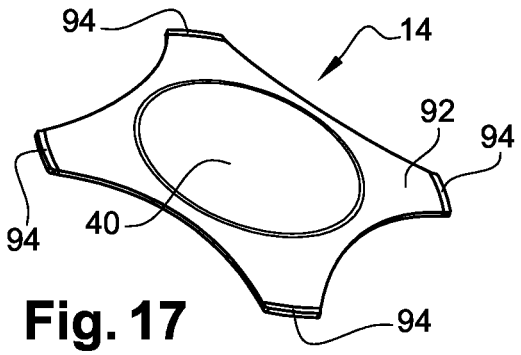
FIGS. 17 and 18 are two top and bottom perspective views of a variant of the design of the movable electrical contact illustrated in FIGS. 1 to 16, in which it is designed as a four-pointed star.
Figure 18:
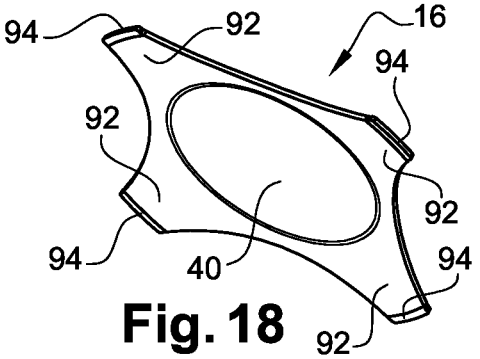
Figure 15:
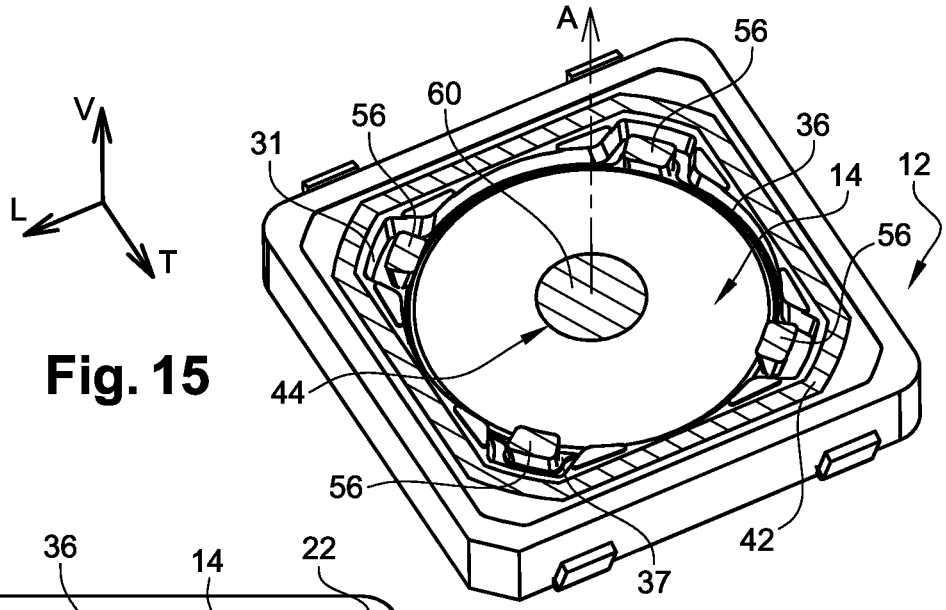
FIG. 15 is a top perspective view of the lower casing base with the movable contact and the actuating body in place in the base, the latter being represented in cross-section by a horizontal plane passing through the four feet of the actuating body resting on the moving electrical contact.
Figure 16:
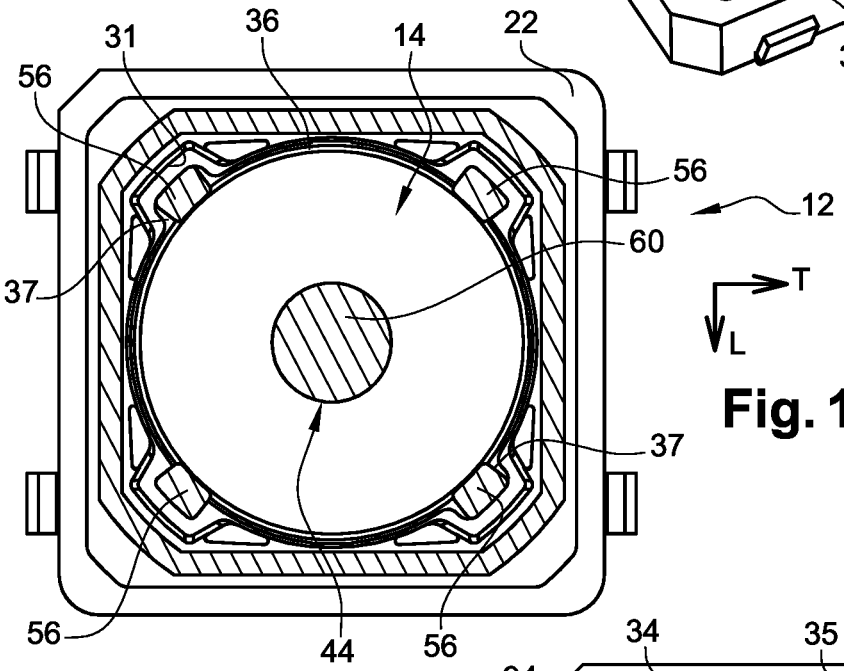
FIG. 16 is a top view of the subassembly shown in FIG. 15.
Figure 19:
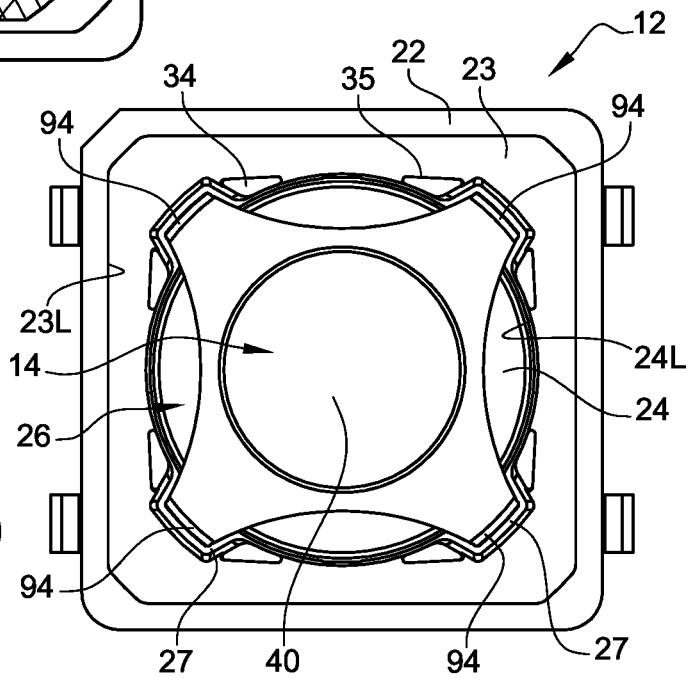
FIG. 19 is a view similar to that of FIG. 5 in which the movable electrical contact of FIGS. 17 and 18 has been shown in the mounted position in the base shown in FIG. 4.

Design Variant of the Movable Electrical Contact (FIGS. 17 to 19)

FIGS. 17 to 19 show a variant of the realization of the movable electrical contact 14.

While performing the same function as a tripping and switching device for the fixed electrical contacts 26 and 28, as that of the electrical contact shown in FIGS. 1 to 13, the electrical contact in this variant is generally in the form of a multi-branched star, in this case with four branches.

Thus, the movable electrical contact 14 has four legs 92, which are angularly distributed at ninety degrees and extend radially outwards from the movable central part 40.

Each leg also extends vertically downwards from the movable central part 40.

Each radial leg has a free end section 94 which is received with clearance in an associated recess 31 of the lower base plate 12.

The four free end sections are coplanar and are arranged on the same circle centered on the A axis.

The conductive underside of each free end section 94 rests vertically downwards on surface 24. Two of these free end sections 94 are in contact with the upper conductive face of the radial tabs 27 of the fixed peripheral electrical contact 26.

Considering FIG. 19, these are the two free end sections 94 in the lower part of the figure.

According to this variant, it is the free end sections 94 that are received in the recesses 31 that ensure the angular immobilization of the movable electrical contact 14 around the axis A.

Each of the support legs 56 of the actuating body 16 is here supported vertically downwards on an associated support area opposite a radial leg 92.

The use of a multi-leg electrical movable contact, depending on the variant, provides a greater actuating-release travel.

In the schematic representation of FIG. 13, the control of the dimensional dimensions along the vertical axis resulting from the design according to the third method is illustrated.

Thus, in the rest state of the electric switch 10 in which, in the absence of actuating force exerted on the upper side 66 of the actuating body:

the upper side 66 of the actuating body is at a precisely determined dimension "C4" from the lower side 11 of the casing 12-19 due to the cooperation of surfaces 90 and 178;

the upper face 66 of the actuating body is at a precise and determined dimension "C3" from the retaining surface 90 formed in the upper cover 19;

the retaining surface 90 formed in the upper cover 19 is at a precise dimension "C2" with respect to the lower face 82 of the upper cover 19;

the parting line "P" of the bottom surface 82 of the upper cover 19 and the top surface 22 of the lower base 12 is at a precise dimension "C1" from the bottom surface 11 of the lower base 12.

As mentioned above, the very high rigidity of the casing components and laser welding ensures the consistency of these different functional dimensions, in particular of the dimensions "C2" and "C4".

In all cases, and as a variant not shown, the point supports can be realized by means of protruding or embossed portions formed on the upper side of the movable electrical contact.

The single-piece actuating body 16 can be made of two materials or two parts glued and/or co-molded etc. Such a design can allow the 64*s* upper section acting as a push button to be made with greater rigidity/hardness than the rest of actuating body 16.

The invention is not limited to an actuating body with a generally square external shape. For example, the peripheral part may be bounded laterally outwardly by a vertical side wall of circular cylindrical contour complementary to the concave side wall so as to be received with a slight radial clearance.

As an alternative not shown, in the assembled and assembled position of all the components of the electrical switch, and in particular of the actuating body housed and clamped in the housing of the lower base, each of the feet can be positioned radially in such a way as to be able to be in point, or substantially point, support axially downwards on a zone opposite the periphery of the upper face of the movable electrical contact, the assembly of the feet being for example arranged substantially on the same circle.

The invention claimed is:

1. An axially actuated tactile electrical switch comprising:

a casing made of insulating material comprising a lower base delimiting a housing open vertically upwards;

a plurality of independent fixed electrical contacts which are arranged in a surface of said base which is oriented vertically upwards, and which comprise at least a first fixed electrical contact and a second fixed electrical contact;

an elastically deformable movable electrical contact which is arranged above said surface of the base and which comprises a peripheral portion in electrical contact with the first fixed electrical contact, and a central portion which is movable, vertically downwards, towards the second fixed electrical contact;

a single piece actuating body of elastic material which is arranged in the casing, and which comprises:

i) a central actuating portion comprising:

a lower actuating portion for actuating the movable electrical contact which is directed downwardly toward the movable portion of the movable electrical contact, and an upper actuating force receiving portion which is arranged to receive a generally vertically downwardly directed force, ii) a peripheral part, connected to the central part, supporting the elastic actuating body with respect to the casing; and iii) an intermediate part which connects the peripheral part and the central actuating part to each other, in that:

the casing made of insulating material comprises an upper cover which extends axially upwards above the lower base and an upper wall of which has a hole through which a free upper end section of the upper portion of the central part of the actuating body axially extends, forming an actuating push-button of the electric switch;

the upper cover has an internal retaining surface; and the upper portion of the central part of the actuating body has an abutment surface which cooperates with said internal retaining surface, towards which it is elastically biased, to determine an upper rest position of the upper portion of the central part of the actuating body with respect to the casing.

2. The electrical switch according to claim 1, characterized in that the upper cover has an upper transverse wall in which said hole is formed, and in that said inner retaining surface is a portion of the inner face of this transverse wall.

3. The electrical switch according to claim 1, characterized in that the upper portion of the center part of the actuating body is a stepped portion having at least two adjacent axial sections delimited by a shoulder whose transverse annular surface constitutes an abutment surface which cooperates with said internal retaining surface of the cover, towards which it is resiliently biased, to determine an upper rest position of the upper portion of the central part of the actuating body with respect to the casing.

4. The electric switch according to claim 1, characterized in that the upper cover is fixed to the lower base by laser welding.

5. The electrical switch according to claim 4, characterized in that the upper cover and the lower base are joined together in a peripheral parting plane which extends in a transverse plane orthogonal to the axis of actuating of the electrical switch.

6. The electrical switch according to claim 5, characterized in that said parting plane extends in a continuous ring.

7. The electrical switch according to claim 1, characterized in that the upper cover comprises a lower annular flange for fixing the upper cover to the lower base and an upper body of truncated conical or cylindrical shape which is stiffened by axial ribs.

8. The electrical switch according to claim 1, characterized in that the peripheral part of the actuating body made of elastic material is housed with radial clearance in a recess of the lower base of the casing.

9. The electrical switch according to claim 1, characterized in that the peripheral part of the actuating body has an annular peripheral lip which is axially clamped in a sealed manner between opposite and facing portions of the base and the upper cover.

10. The electrical switch according to claim 9, characterized in that the lower base comprises positioning and holding elements which cooperate with the annular peripheral lip of the peripheral part of the actuating body.

11. The electrical switch according to claim 1, characterized in that the actuating body is elastically biased upwards by the elastically deformable movable electrical contact which is in permanent elastic abutment against the lower portion of the central part of the actuating body.

12. The electrical switch according to claim 1, characterized in that the movable contact is arranged such that:

in a normal state of rest, the movable central portion of the movable electrical contact is spaced from said fixed central electrical contact; and when the movable contact is subjected to a vertically downward actuating force of a predetermined value, the movable central portion of the movable electrical contact is in contact with the second fixed electrical contact, so as to electrically connect the first and second fixed electrical contacts.

13. The electrical switch according to claim 1, characterized in that the actuating body is made by molding in a silicone-based elastomeric material.

14. The electrical switch according to claim 1, wherein the intermediate part does not contact the upper cover.

15. An axially actuated tactile electrical switch comprising:

a casing made of insulating material comprising a lower base delimiting a housing open vertically upwards;

a plurality of independent fixed electrical contacts which are arranged in a surface of said base which is oriented vertically upwards, and which comprise at least a first fixed electrical contact and a second fixed electrical contact;

an elastically deformable movable electrical contact which is arranged above said surface of the base and which comprises a peripheral portion in electrical contact with the first fixed electrical contact, and a central portion which is movable, vertically downwards, towards the second fixed electrical contact;

a single piece actuating body of elastic material which is arranged in the casing, and which comprises:

i) a central actuating portion comprising:

a lower actuating portion for actuating the movable electrical contact which is directed downwardly toward the movable portion of the movable electrical contact, and an upper actuating force receiving portion which is arranged to receive a generally vertically downwardly directed force, ii) a peripheral part, connected to the central part, supporting the elastic actuating body with respect to the casing; and iii) an intermediate part which connects the peripheral part and the central actuating part to each other, wherein:

the casing made of insulating material comprises an upper cover which extends axially upwards above the lower base and an upper wall of which has a hole through which a free upper end section of the upper portion of the central part of the actuating body axially extends, forming an actuating push-button of the electric switch;

the upper cover has an internal retaining surface;

the intermediate part does not contact the upper cover; and the upper portion of the central part of the actuating body has an abutment surface which cooperates with said internal retaining surface, towards which it is elastically biased, to determine an upper rest position of the upper portion of the central part of the actuating body with respect to the casing.

16. An axially actuated tactile electrical switch comprising:

a casing made of insulating material comprising a lower base delimiting a housing open vertically upwards;

a plurality of independent fixed electrical contacts which are arranged in a surface of said base which is oriented vertically upwards, and which comprise at least a first fixed electrical contact and a second fixed electrical contact;

an elastically deformable movable electrical contact which is arranged above said surface of the base and which comprises a peripheral portion in electrical contact with the first fixed electrical contact, and a central portion which is movable, vertically downwards, towards the second fixed electrical contact;

a single piece actuating body of elastic material which is arranged in the casing, and which comprises:

i) a central actuating portion comprising:

a lower actuating portion for actuating the movable electrical contact which is directed downwardly toward the movable portion of the movable electrical contact, and an upper actuating force receiving portion which is arranged to receive a generally vertically downwardly directed force, ii) a peripheral part, connected to the central part, supporting the elastic actuating body with respect to the casing; and iii) an intermediate part which connects the peripheral part and the central actuating part to each other, wherein:

the casing made of insulating material comprises an upper cover which extends axially upwards above the lower base and an upper wall of which has a hole through which a free upper end section of the upper portion of the central part of the actuating body axially extends, forming an actuating push-button of the electric switch;

the upper cover has an internal retaining surface;

the upper portion of the central part of the actuating body has an abutment surface which cooperates with said internal retaining surface, towards which it is elastically biased, to determine an upper rest position of the upper portion of the central part of the actuating body with respect to the casing; and the upper portion of the center part of the actuating body is a stepped portion having at least two adjacent axial sections delimited by a shoulder whose transverse annular surface constitutes an abutment surface which cooperates with the internal retaining surface of the cover, towards which the abutment surface is resiliently biased, to determine an upper rest position of the upper portion of the central part of the actuating body with respect to the casing.

* * * * *